United States Patent [19]

Hinds et al.

[11] 4,018,582

[45] Apr. 19, 1977

[54] VENT TUBE MEANS FOR A CRYOGENIC CONTAINER

[75] Inventors: Duane E. Hinds; Richard C. Ankney, both of Davenport, Iowa

[73] Assignee: The Bendix Corporation, South Bend, Ind.

[22] Filed: Mar. 29, 1976

[21] Appl. No.: 671,196

[52] U.S. Cl. ..... 62/50; 137/43

[51] Int. Cl.[2] ..... F17C 7/02

[58] Field of Search ..... 62/45, 50, 51, 55; 137/43

[56] References Cited

UNITED STATES PATENTS

| | | | |
|---|---|---|---|
| 2,456,889 | 12/1948 | Olson | 62/51 |
| 3,364,688 | 1/1968 | Matlow et al. | 62/55 X |
| 3,614,960 | 10/1971 | Pfrengle | 137/43 |
| 3,707,078 | 12/1972 | Cramer | 62/50 |

*Primary Examiner*—Ronald C. Capossela
*Attorney, Agent, or Firm*—Leo H. McCormick, Jr.; Ken C. Decker

[57] ABSTRACT

A vent tube having a first branch and a second branch for use in a cryogenic container through which the interior of the container is communicated to the atmosphere. The cryogenic container is adapted to receive a fixed volume of cryogenic fluid at a uniform temperature and density. In a filling operation, the first branch of the vent tube contacts the cryogenic fluid and carries a portion of the fluid to the atmosphere to inform an operator that the capacity of the container has been reached. After the container is filled, the temperature in the stored cryogenic fluid rises. As the temperature changes, distinct stratified layers of fluid of different densities and temperatures can be measured in the container. The change in temperature causes the cryogenic fluid to expand and submerge the adjacent first branch of the vent tube. Thereafter, the second branch, which is located at the gravitational top of the container, provides a flow path to the atmosphere for the top layer of cryogenic fluid to assure that the higher density cryogenic fluid is retained in the container means.

11 Claims, 5 Drawing Figures

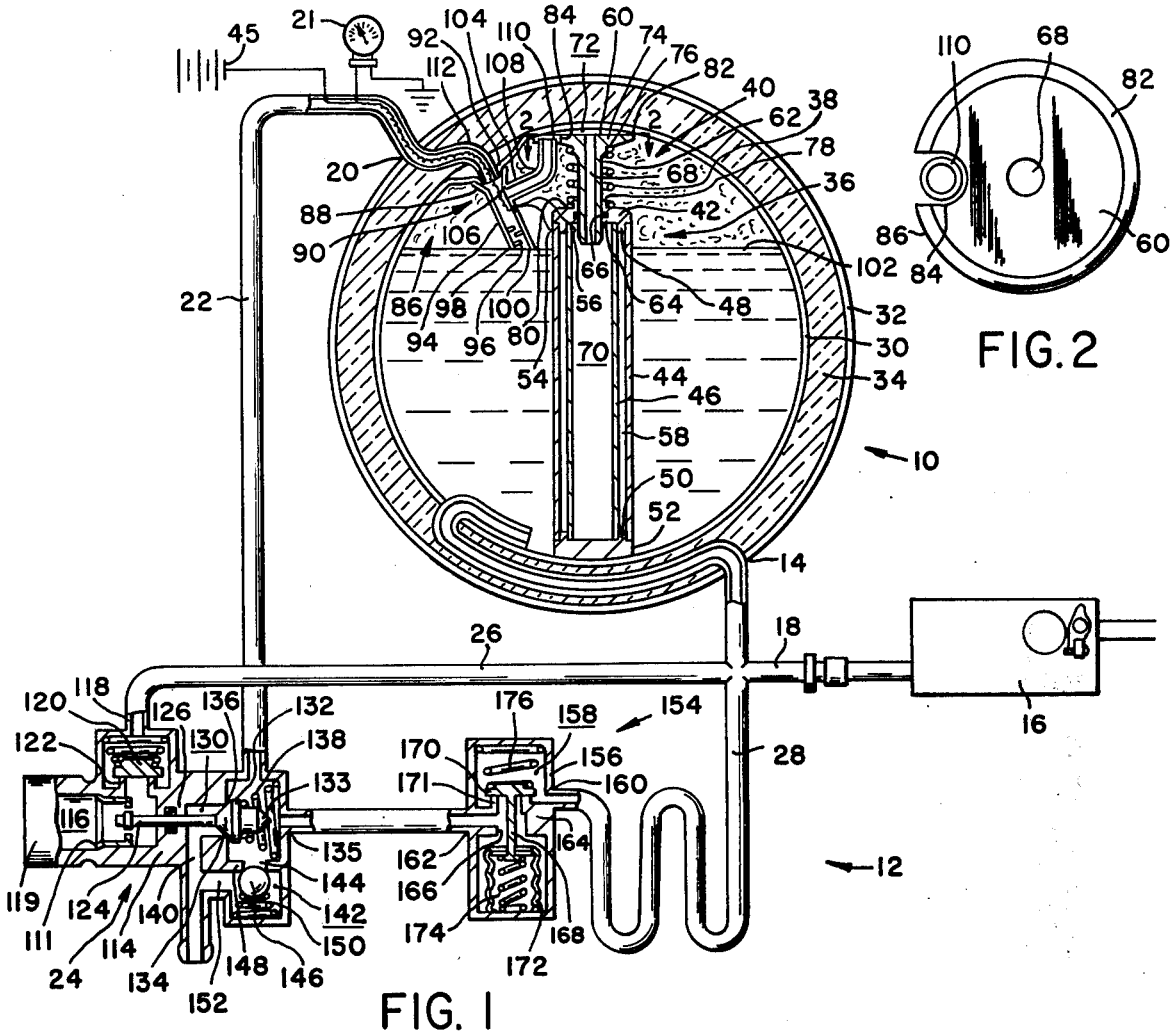
FIG. 1
FIG. 2
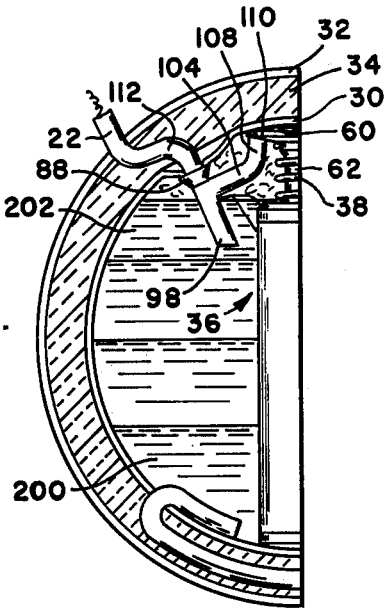
FIG. 3
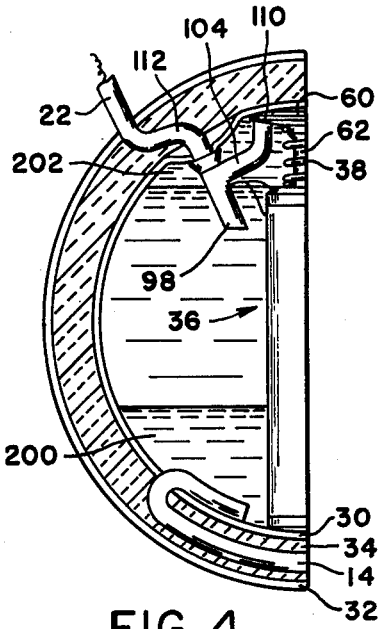
FIG. 4
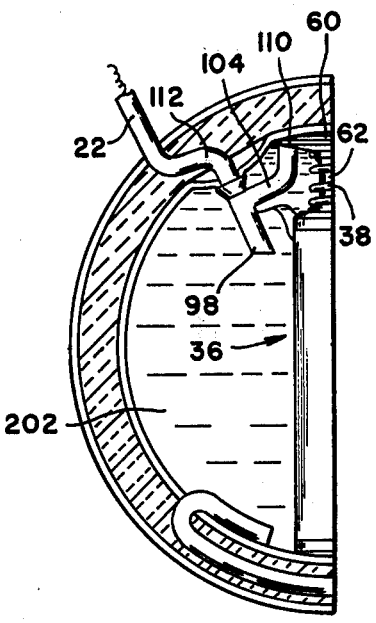
FIG. 5

VENT TUBE MEANS FOR A CRYOGENIC CONTAINER

BACKGROUND OF THE INVENTION

On most military aircraft, liquid oxygen is needed to supplement or enrich the atmosphere at flying altitudes. Liquid oxygen is stored in cryogenic containers.

It has been found that when a cryogenic container, such as shown in U.S. Pat. No. 3,043,466, is filled with liquid oxygen and allowed to warm up, the temperature of the liquid on the top surface rises more rapidly than the remaining mass of the stored liquid oxygen. Because of this temperature difference, stratified layers of oxygen at different temperatures and density are present in the stored liquid oxygen. The layer of liquid oxygen having the temperature and lowest density is located on the top of the liquid oxygen. Thus, even though the stored liquid oxygen is stratified, it is in a fairly stable internal condition. Unfortunately as the temperature of the liquid oxygen rises, the volume of the liquid oxygen expands. The expansion of the liquid oxygen covers a vent port causing increase in the internal pressure in the cryogenic container. After the internal pressure reaches a predetermined value, a relief valve such as shown in U.S. Pat. No. 3,707,078 opens and a portion of the liquid oxygen is vented through a relief port to the atmosphere. Once the liquid oxygen in a cryogenic container has been warmed to a point where venting is required, a rapid reduction in the retained volume takes place. The stand-by time for most cryogenic containers is about 48 hours. Therefore, if an aircraft is on the ground for longer than two days without being serviced, each cryogenic container must be refilled to a preset volume to assure the aircraft personnel of sufficient oxygen to operate the aircraft.

SUMMARY OF THE INVENTION

We have found that the thermal input into the cryogenic fluid in a container causes thermal expansion into stratified layers of liquid. The upper layer of the liquid cryogen undergoes a large expansion while the lower layer experiences little or no expansion during an initial stand-by time period. Therefore, for optimum operation we determined that it would be desirable to sequentially allow a gas head and thereafter the top layer of liquid cryogen to be vented to the atmosphere. To achieve this desired operation, we devised a relief means for communicating the gravitational top of the container to the atmosphere.

The relief means has a head member which is attached to the vent port of the cryogenic container. The head member has a first vent tube and a second vent tube connected to a central tube. The first vent tube extends from the central tube and contacts the liquid oxygen during filling to inform the operator that a predetermined volume has been placed in the container while a second vent tube extends to a position adjacent the apex of the container. A retainer means, through which a fluid level indicator means is aligned with the apex, has a base plate to which the second vent tube is connected to positively retain the end thereof adjacent the apex of the container. During a stand-by storage time period, as the thermal energy in the liquid oxygen increases, the top layers of the stratified liquid cryogen is communicated through the second vent tube to the atmosphere. Thus, the warmer liquid in the container is the first communicated to the atmosphere thereby increasing the stand-by time by reducing the boil-off of liquid cryogen.

It is therefore the object of this invention to provide a cryogenic container with vent tube means whereby the top layer of liquid oxygen is always the first to be relieved to the atmosphere during a stand-by operation.

It is another object of this invention to provide a cryogenic container with a vent tube means having a first branch through which a liquid cryogen is communicated to the atmosphere during a filling operation and a second branch through which the apex area of the container is communicated to the atmosphere during a stand-by operation.

It is a further object of this invention to provide a cryogenic container with a relief means through which the lowest density fluid of stratifed layers of cryogenic fluid is sequentially communicated to the atmosphere during a stand-by operation.

It is a further object of this invention to provide a cryogenic container with a relief means through which the lowest density fluid of stratified layers of cryogenic fluid is communicated to the atmosphere during a stand-by operation.

These and other objects will become apparent from reading this specification and viewing the drawings.

BRIEF DESCRIPTION OF THE DRAWINGS

FIG. 1 is a sectional view of a cryogenic container made in accordance with the teachings of this invention;

FIG. 2 is a sectional view taken along line 2—2 of FIG. 1;

FIG. 3 is a fractional sectional view of a segment of the cryogenic container of FIG. 1 showing the stratification of the cryogenic fluid after a first stand-by period;

FIG. 4 is a fractional sectional view of a segment of the cryogenic container of FIG. 1 showing stratification of the cryogenic fluid after a second stand-by period; and FIG. 5 is a fractional sectional view of a segment of the cryogenic container of FIG. 1 showing the cryogenic fluid after a third stand-by period.

DETAILED DESCRIPTION OF THE PREFERRED EMBODIMENT

The cryogenic container means 10 shown in FIG. 1 is connected to a breathing system 12. The cryogenic container means 10 has an entrance port 14 connected to a regulator device 16 through a distribution conduit 18 and a relief port 20 connected to a filler vent valve means 24 through relief conduit 22. The filler vent valve means 24 is connected to the distribution conduit 18 by a fill conduit 26. This distribution conduit 18 is connected to the relief conduit 22 through a build-up conduit 28 to form a liquid oxygen-to-gaseous oxygen conversion system through which the regulator device 16 supplies a recipient with oxygen to meet the physiological demans encountered in various flying altitudes.

In more particular detail, the cryogenic container means 10 has an inner vessel 30 separated from an outer vessel 32 by an insulating chamber 34. The insulating chamber 34 is usually evacuated. However, a low thermal closed cell can be located between the vessels 30 and 32 to effectively prevent the transfer of thermal energy from the atmosphere to the cryogenic liquid by conduction.

A fluid indicator means 36 of the type illustrated in U.S. Pat. No. 2,848,466 is located on a radius intersecting with the gravitational top of the container means 10. A resilient means 38 is caged between a retainer means 40 and a cap piece 42. The fluid level indicator means 36 provides an operator with an indication of the volume of fluid in the cryogenic container means 10 during oxygen consumption.

The fluid indicator means 36 has a first cylindrical probe or sensor 44 concentrically separated from a second cylindrical probe or sensor 46 by first shoulder 48 on the cap piece 42 and second shoulder 50 on the base member 52. The first and second probes or sensors 44 and 46 are provided with leads 54 and 56 which are carried through the vent port 20 and relief conduit 22 to provide a gauge 21 with an electrical signal indicative of the volume of liquid in the inner vessel 30. Both the cap pieces 42 and the base member 52 are of an electrical insulative material in order not to affect the generation of the electrical signal. An electrical input signal from battery source 45 is transmitted through lead 54 to the first sensor 44. The electrical input signal is carried across gap 58 to the second sensor 46 through lead 56 to the gauge 21. The flow of electrical current across the gap 58 is directly proportional to the volume of liquid oxygen in the container means 10. The relationship between the electrical input on lead 54 to the electrical output on lead 56 as measured by the gauge 21 provides an operator with an indication of the volume of liquid in the inner vessel 30.

The retainer means 40 which aligns the fluid indicator means 36 along a radius intersecting at the gravitational top of the inner vessel 30 has a base plate 60 with a cylindrical body 62 extending therefrom. The cylindrical body 62 extends through opening 64 in the cap piece 42. A seal 66 resiliently holds the cylindrical body 62 in the cap piece 42. An axial bore 68 extends through both the base plate 60 and the cylindrical body 62 to provide a communication between the interior 70 of the cylindrical probe 46 and the apex area 72 of the inner vessel 30. The base plate 60 has a ledge 74 for retaining a first end 76 of the resilient or spring means 38. The cap piece 42 also has a ledge 78 for retaining the second end 80 of the resilient or spring means 38. The base plate 60 has a slightly rounded surface 82 which matches with the surface of the inner vessel 30. The base plate 60 has an axial aperture 84 located along or adjacent the peripheral surface 86 (see FIG. 2). The axial aperture 84 is located along a plane which runs through the vent port 20 and the axial bore 68. The base plate 60 is connected to a relief means 86 through the axial aperture 84.

The relief means 86 has a head member 90 with a flared end 88 which surrounds flange 92 on the inner vessel 30. A first tube 94 extends from the head member 90 along a radial line which is normal to the tangential surface of the vent port 20. The first tube 94 has a series of baffles 96 located along the end 98. The end 98 of the first tube 94 has a beveled surface 100 which is parallel to the fill line 102. The fill line 102 represents the volumetric capacity of the inner vessel 30 which is most effective in the liquid to gaseous oxygen conversion system.

A second tube 104 is attached to the first tube 94 adjacent the head member 90 by a weld 106. The second tube 104 has a bend 108 whereby the end 110 of the tube is parallel to the axial bore 68 in the retainer means 40. The end 110 of the tube is located in the axial aperture 84 to maintain the end 110 adjacent the gravitational top area 72 in the inner vessel 30. The leads 54 and 56 are preferably carried through the interior of the first tube 94 into the head member 88, past elbow 112 in the relief conduit 22 before being carried through connector to the indicator gauge 21 and electrical energy source 45.

The filler vent valve means 24 has a housing 114. The relief conduit 22 and the build-up conduit 28 are connected to the atmosphere through the housing 114. A supply chamber 116 in housing 114 has an opening 118 connected to the fill conduit 26. A spring controlled closure cap 120 which is urged against seat 122 prevents flow from the fill conduit 26 back into the supply chamber 116. A shaft 124 which is retained in a bearing wall 126 extends from the supply chamber 116 into a bypass chamber 130. A head member 152 located in the bypass chamber 130 is attached to the shaft 124. The head member 132 has a first beveled face 134 which is urged against seat 136 by spring 138 to prevent atmosphere from entering the bypass chamber 130 through atmospheric passageway 140. The bypass chamber 130 is connected to a relief chamber 142 by a passage 144. A ball 146 is held against a seat 148 by a spring 150 located in the relief chamber 142. An internal passageway 152 connects the relief chamber 142. An internal passageway 152 connects the relief chamber 142 with the atmospheric passage 140. The spring 150 is selected to control the internal pressure build-up in the inner vessel 30 during the stand-by time period after filling the cryogenic container means 10 with liquid oxygen.

An interrupter valve means 152 is located in the build-up conduit 28 to control the pressure at which the oxygen is communicated through the distribution conduit 18 to the regulator means 16. The interrupter valve means 154 has a housing 156 with a control chamber 158. The control valve chamber 158 has an entrance port 160 and an exit port 162 connected to the build-up conduit 28. The housing 156 has a wall 164 which separates the entrance port 160 from the exit port 162. The wall 164 has a bore 166 through which the entrance port 160 is connected to the exit port 162. A stem 168 has a face 170 located on a first end and a bellows member 172 located on a second end. A spring 174 located inside the bellows member 172 acts on the stem 168 to oppose a closure spring 176. Without pressure in the control chamber 158, the bellows member in conjunction with spring 174 urges face 170 away from the bore 166. As the pressure in the control chamber increases, the bellows member 172 collapses to allow the closure spring 176 to urge face 170 on wall 164 surrounding bore 166. With face 170 against wall 164 the communication between the entrance port 160 and the exit port 162 is interrupted. As the pressure across face 170 drops due to a demand for gaseous oxygen on the breathing regulator means 16, spring 174 overcomes closure spring 176 and allows fluid to flow between the entrance port 160 and the exit port 162 and develop an operational pressure for delivery to the regulator valve means 16.

MODE OF OPERATION OF THE PREFERRED EMBODIMENT

The cryogenic container means 10 is filled with liquid oxygen by inserting a nozzle (not shown) into sleeve 119 extending from the supply chamber 116 of the housing 114. The nozzle is adapted to engage shoulder 111 of shaft 124 and move the first face 134 away from seat 136 to allow the relief chamber 142 free communication with the atmoshere. At the same time, a second beveled face 133 engages seat 135 to prevent fluid communication from the build-up conduit 28 into the bypass chamber 130.

Liquid oxygen under pressure released from the nozzle overcomes the resiliency of the spring controlled closure cap 120 and freely flows in fill conduit 26, through the distribution conduit 18, past the entrance port 14, and into the bottom of the inner vessel 30. Since the first face 134 of shaft 124 in the bypass chamber 130 is unseated, the top of the inner vessel 30 is vent to the atmosphere and liquid oxygen freely enters vessel 30. When the liquid oxygen approaches the maximum fill line 102, the beveled surface 100 on the end 98 of the first tube 94 engages the surface of the liquid oxygen. When the liquid oxygen contacts the beveled surface 100, as shown in FIG. 1, liquid droplets intermingle with the gas in the inner vessel 30. The gas and liquid droplets are communicated through the first tube 94 to the relief conduit 22 and into the bypass chamber 130 before passing through passageway 140 to the atmosphere. When liquid droplets are communicated through the atmospheric passage 140, the volumetric capacity of the cryogenic container means 10 has been reached. When this occurs, the liquid oxygen has a temperature of −297° F. and a density of 9.5 pounds per gallon. The gas in the gravitational top area 72 is at atmospheric pressure, since the second tube means 104 is opened to the atmosphere through the relief conduit 22. The operator now withdraws the nozzle from the sleeve 119 to allow spring 138 to urge face 134 against seat 136 to prevent loss of liquid oxygen through the bypass chamber 130 into the atmosphere passageway 140.

In the stand-by time period, thermal energy passes through the cryogenic container means 10 to warm the liquid oxygen. As the liquid oxygen is warmed, stratified layers having disticnt physical characteristics will be produced in the inner vessel 30. As shown in FIG. 3, the lower layer 200 of liquid oxygen has a temperature of −297° F., while the upper layer 202 of liquid oxygen adjacent the liquid gaseous surface has a temperature of −215° F. and a density of 6.95 pounds per gallon. Each layer of liquid oxygen has a different density and different expansion characteristics. As expansion occurs within the inner vessel 30, end 98 of the first tube 94 is submerged in liquid oxygen. Thereafter all communication into the relief conduit 22 occurs through the second tube 104. In order to reduce the possibility of liquid oxygen being communicated through the first tube 98, baffles 96 as shown in FIG. 1 prevent liquid from passing through the first tube 98. In some instances it may be necessary to install a one-way check valve means on or adjacent the end 98 to positively assure that the liquid oxygen is not communicated through the first tube 94.

In the storage time sequence, shown in FIG. 3, the pressure of the liquid oxygen is the vessel 30 approaches 350 pounds per square inch. At this pressure, spring 150 in the relief chamber 142 is overcome and the gas in the apex area 72 vented to atmosphere. As thermal energy continues to pass through the cryogenic container means 10, the temperature in the lower layers 200 of liquid oxygen begins to rise and expand to a point where all the gas in the apex area 72 is vented to the atmosphere, as shown in FIG. 4.

When the liquid oxygen starts to expand, the axial bore 68 in the retainer means 40 acts as a direct connection with the second tube 104 in order that the warmer gas and liquid oxygen is first to be communicated to the atmosphere through the relief conduit 22. After a predetermined time (approximately 164 hours), the liquid oxygen in the inner vessel has a uniform temperature of about −215° F., a density of 6.95 pounds per gallon, and a pressure of 350 pounds per square inch. At this time, the capacity of the original liquid oxygen has been reduced about 25% and if the aircraft is scheduled for a flight, more liquid oxygen has to be added to the inner vessel 30 to assure that the physiological requirements of the aircraft personnel can be met without a decrease in the range of the aircraft.

If the regulator means 16 is actuated, liquid oxygen is allowed to be communicated into the distribution and build-up conduits 18 and 28. The liquid oxygen in the build-up conduit 28 rapidly expands into gaseous oxygen. the high pressure gaseous oxygen is communicated through the bypass chamber 130 to the relief conduit 22 and into the apex area 72 to provide force to push the liquid oxygen into the distribution conduit 18. As the pressure of the gaseous oxygen increases, spring 176 overcomes spring 174 to urge face 170 on seat 171 to prevent communication to the apex area 72 of the inner vessel 30.

We have found that a cryogenic container means 10 equipped with a vent tube or relief means 86 retains a volume of liquid oxygen initially communicated to the inner vessel 30 about twice as long as known prior art devices.

We claim:

1. In a container means for storing a cryogenic fluid, said cryogenic fluid initially possessing a uniform temperature and density in a first stage of storage, said cryogenic fluid separating into stratified layers of cryogenic fluid each of which has a different density and temperature resulting from thermal expansion of the initial cryogenic fluid in a second stage of storage, the layer of cryogenic fluid adjacent a gravitational top of the container means having the lowest density and the highest temperature, relief means for communicating the container means to the atmosphere to minimize the loss of cryogenic fluid during said second stage of storage, said relief means comprising:

vent tube means having a first branch and a second branch for communicating cryogenic fluid through a vent port to the atmosphere, said first branch contacting said cryogenic fluid in said first stage of storage to allow communication of cryogenic fluid to the atmosphere to inform an operator of the presence of a predetermined quantity of cryogenic fluid in the container means, said layers of cryogenic fluid thermally expanding during said second stage of storage to submerge said first branch in the cryogenic fluid, said second branch extending to a position adjacent the apex of the container means to allow the layer of cryogenic fluid having the lowest density and the highest temperature to be the first communicated to the atmosphere during said thermal expansion.

2. The container means, as recited in claim 1, wherein said vent tube means includes:

baffle means connected to said first branch for restricting the flow therethrough during said second stage of storage.

3. The container means, as recited in claim 2, wherein said vent tube means includes:

a head member connected to said first branch and said second branch for communicating the interior of the container means to the atmosphere through said vent port, said head member having a flared end which is secured to the container means surrounding said vent port.

4. The container means, as recited in claim 3, wherein said container means surrounding the single vent port includes:

a flange which extends into the flared end of the head member to provide a tangential connection between the container means and a relief conduit.

5. A cryogenic storage contaner comprising:

a vessel for holding a quantity of liquid cryogen, said liquid cryogen initially possessing a uniform temperature and density in a first stage of storage, said liquid cryogen being separated into stratified layers of cryogenic fluid each of which have a different density and temperature resulting from thermal expansion of the initial liquid cryogen in a second stage of storage, the layer of liquid cryogen adjacent a gravitational top of said vessel having the lowest density and the highest temperature;

retainer means located in said vessel adjacent said gravitational top in the vessel; and vent tube means having a first branch and a second branch for communicating liquid cryogen through a vent port in said vessel to the atmospbere, said first stage of storage to permit communication of liquid cryogen and gas to the atmosphere for informing an operator of the presence of a predetermined quantity of liquid cryogen in the container means, said layers of liquid cryogen thermally expanding during said second stage of storage to submerge said first branch in the liquid cryogen, said second branch being connected to said retainer means to allow the layer of liquid cryogen adjacent said gravitational top having the lowest density and the highest temperature to be first communicated to the atmoshere during said second stage of storage.

6. The cryogenic storage container, as recited in claim 5, wherein said retainer means includes:

a base plate having an aperture adjacent its periphery for holding said second branch adjacent said gravitational top of the vessel.

7. The cryogenic storage container, as recited in claim 6, wherein said vent tube means includes:

baffle means connected to said first branch for restricting the flow therethrough during said second stage of storage.

8. The cryogenic storage container, as recited in claim 7, wherein said vent tube means further includes:

a head member connected to said first branch and said second branch for communicating the interior of the container means to the atmosphere through said port, said head member having a flared end secured to the container means surrounding said vent port.

9. Apparatus for storing cryogenic fluid comprising:

a housing defining a chamber therewithin;

means for filling said chamber with cryogenic fluid, said cryogenic fluid initially having a uniform density and temperature but having a non-uniform density and temperature after being stored in said apparatus for a period of time;

vent tube means extending through the wall of said housing into said chamber and venting said cryogenic fluid when the container is filled to limit the volume of fluid received in said chamber to less than the volume of the latter whereby a portion of the chamber is reserved to accommodate expansion of the cryogenic fluid; and said vent tube means including means communicating with the portion of the chamber adapted to receive the portion of the cryogenic fluid having the lowest density and highest temperature so that upon expansion of the cryogenic fluid beyond the capacity of the chamber to accommodate such expansion, the portion of the cryogenic fluid having the lowest density and highest temperature is vented through said vent tube means.

10. The apparatus, as recited in claim 9, wherein said vent tube means includes:

a first branch for venting said cryogenic fluid during said filling;

a second branch for venting said cryogenic fluid during said expansion; and baffle means for alternating the venting through said first branch during said expansion.

11. The apparatus, as recited in claim 10, wherein said vent tube means further includes:

retainer means for holding said second branch adjacent the gravitational top of said container.

* * * * *